US006431178B1

(12) United States Patent
Usami et al.

(10) Patent No.: US 6,431,178 B1
(45) Date of Patent: Aug. 13, 2002

(54) HAIR DYEING TOOL HAVING DISPENSING MECHANISM

(75) Inventors: Hideyuki Usami, Tokyo; Kenji Nakamura, Osaka, both of (JP)

(73) Assignees: Pentel Kabushiki Kaisha; Kabushiki Kaisha Taiki, both of (JP)

( * ) Notice: Subject to any disclaimer, the term of this patent is extended or adjusted under 35 U.S.C. 154(b) by 0 days.

(21) Appl. No.: 09/463,873

(22) PCT Filed: May 24, 1999

(86) PCT No.: PCT/JP99/02700

§ 371 (c)(1),
(2), (4) Date: Jan. 31, 2000

(87) PCT Pub. No.: WO99/62368

PCT Pub. Date: Dec. 9, 1999

(30) Foreign Application Priority Data

Jun. 2, 1998 (JP) ..... 10-169255

(51) Int. Cl.[7] ..... A45D 24/22
(52) U.S. Cl. ..... 132/112; 401/205
(58) Field of Search ..... 132/108, 109, 132/110, 112, 116, 125, 126, 139, 221, 218; 401/196, 198, 199, 205, 206, 271, 282, 283

(56) References Cited

U.S. PATENT DOCUMENTS

| | | | | | |
|---|---|---|---|---|---|
| 886,996 | A | * | 5/1908 | Loring | 401/176 |
| 2,218,471 | A | * | 10/1940 | Hickey | 132/116 |
| 4,913,175 | A | * | 4/1990 | Yokosuka et al. | 132/317 |
| 5,343,880 | A | * | 9/1994 | McKay | 132/116 |
| 5,960,802 | A | * | 10/1999 | Sakai | 132/320 |

FOREIGN PATENT DOCUMENTS

| | | |
|---|---|---|
| JP | 63-95504 | 6/1988 |
| JP | 4-303 | 1/1992 |
| JP | 4133732 | 12/1992 |
| JP | 8-38237 | 2/1996 |
| JP | 8-70929 | 3/1996 |
| JP | 9314029 | 12/1997 |

* cited by examiner

*Primary Examiner*—Todd E. Manahan
*Assistant Examiner*—David C. Comstock
(74) *Attorney, Agent, or Firm*—Adams & Wilks

(57) ABSTRACT

A hair dyeing tool including a fluid storage chamber defined within a container body and adapted to store a coating liquid therein and a coating member having a comb member disposed forwardly of the container body. The container body serves directly as the fluid storage chamber. A valve mechanism is disposed between the fluid storage chamber and the comb member, and a rear knock member is disposed backwardly of the container body so that it is actuated by the valve mechanism to eject the hair dye liquid forwardly.

19 Claims, 8 Drawing Sheets

HAIR DYEING TOOL HAVING DISPENSING MECHANISM

TECHNICAL FIELD OF THE INVENTION

The present invention relates to a hair-dye applicator or a hair dyeing tool including a fluid storage chamber defined within a container body and adapted to store a coating (hair-dye) liquid therein and a comb member disposed forwardly of the container body, wherein a valve mechanism is disposed between the fluid storage chamber and the comb member and the valve mechanism is actuated by a knock member disposed on the container body.

BACKGROUND OF THE INVENTION

A discharging mechanism for a coating liquid to a comb member by releasing a valve of a valve mechanism is known in the art such as for example, a discharging tool disclosed in Japanese Utility Model Publication (Unexamined) No. S63-95504. In the discharging tool disclosed in this publication, a reservoir tank including a valve mechanism therein is disposed within a cylindrical member having a longitudinal axis such that the reservoir tank is slidably moved relative to the cylindrical member. A cap is attached to a rear part of the reservoir tank. By knocking or depressing the cap from the back of the cylindrical member, the reservoir tank is moved to release the valve mechanism so that a head hair cosmetic material stored in the reservoir tank is supplied to a brush.

However, the above conventional technique possesses the following problems. Since the cylindrical member and the storage tank are constituted of separate parts, a cost for the parts is increased and the working process for assembly of such component parts is increased, too. As a consequence, the cost of the final product becomes higher. Or otherwise, the cost of other parts must be reduced in order to maintain a reasonable price of the final product in the market. Reduction of the cost of other parts results in degraded performance of the final product. This is totally unacceptable, particularly as a container of cosmetic material, which is to be adhered to a human body (head hairs) and therefore taken care of from a hygienic point of view. It is very difficult to achieve the reduction of the cost of other parts without sacrifice of the performance.

DISCLOSURE OF THE INVENTION

The present invention has been made in view of the above problems. The subject matter of the present invention resides in a hair dyeing tool (hair-dye applicator) comprising:

a container body, a fluid storage chamber defined within the container body and adapted to store a coating liquid therein, a coating section having a comb member disposed forwardly of the container body, wherein the container body is designed to serve directly as the fluid storage chamber, a valve mechanism is disposed between the fluid storage chamber and the comb member and a rear knock member disposed backwardly of the container body actuates the valve mechanism so that the coating liquid is ejected forwardly.

In a preferred embodiment of the present invention, the fluid storage chamber may include a liquid reservoir portion adapted to temporarily reserve the coating liquid so that the locating liquid is ejected from the fluid storage chamber by means of actuation of the rear knock member. The coating member may be provided on a peripheral surface thereof with a plurality of the comb members.

In another embodiment of the present invention, the coating member may include a plurality of longitudinal grooves formed in a surface thereof and the coating member may include a plurality of comb members formed on a peripheral surface thereof.

The coating member is allowed to extend through an interior of a basal portion of the comb member and capable of seeping the coating liquid out of a region thereof which is exposed from the comb member.

The coating member is provided in such a manner as to project from the liquid reservoir portion so that the coating liquid can permeate therein rapidly.

The coating member is slidingly moveable back and forth within the comb member(s) by means for actuation of the valve mechanism.

The coating liquid is directly permeated into the coating member from the fluid storage chamber by means of actuation of the rear knock member.

DETAILED DESCRIPTION OF THE PREFERRED EMBODIMENTS

Figure 1:
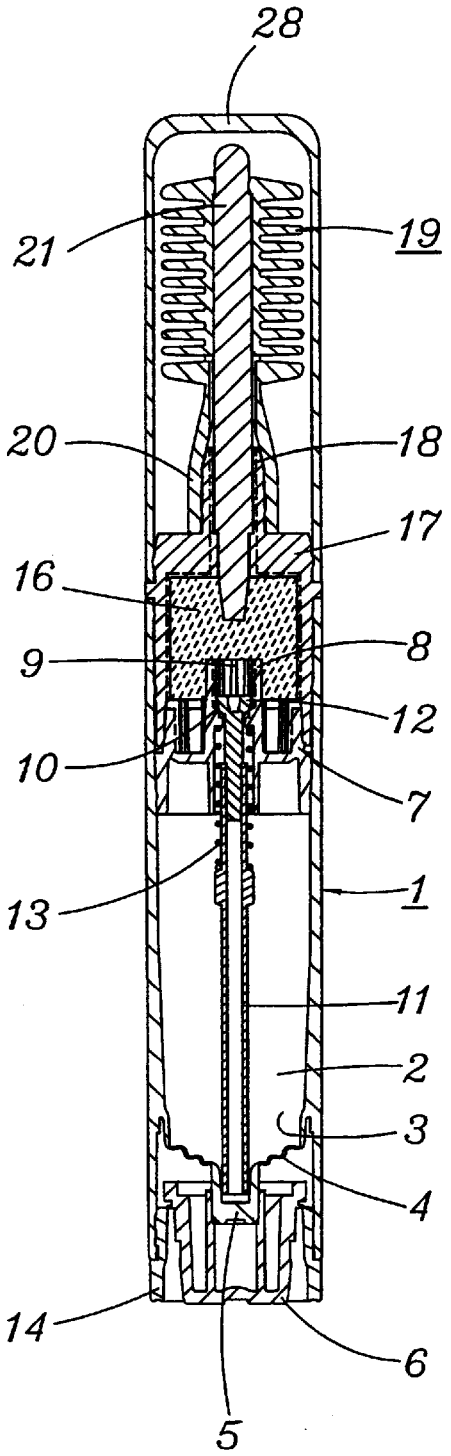
FIG. 1 is a vertical sectional view of a hair dyeing tool according to a first embodiment of the present invention.
Figure 3:
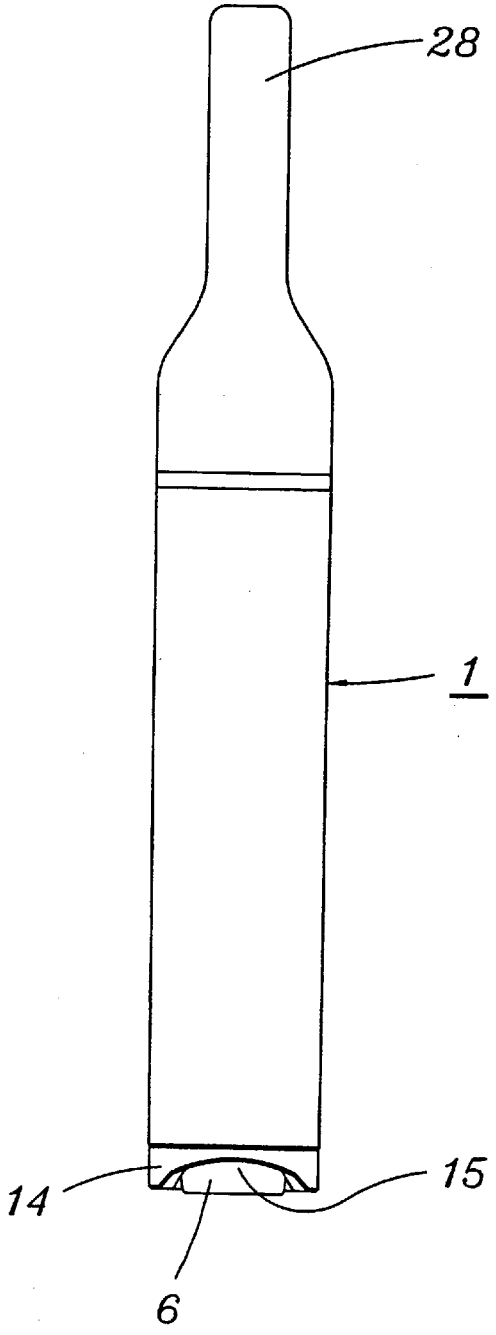
FIG. 3 is a view showing an outer appearance of the hair dyeing tool of the present invention shown in FIG. 1.
Figure 2:
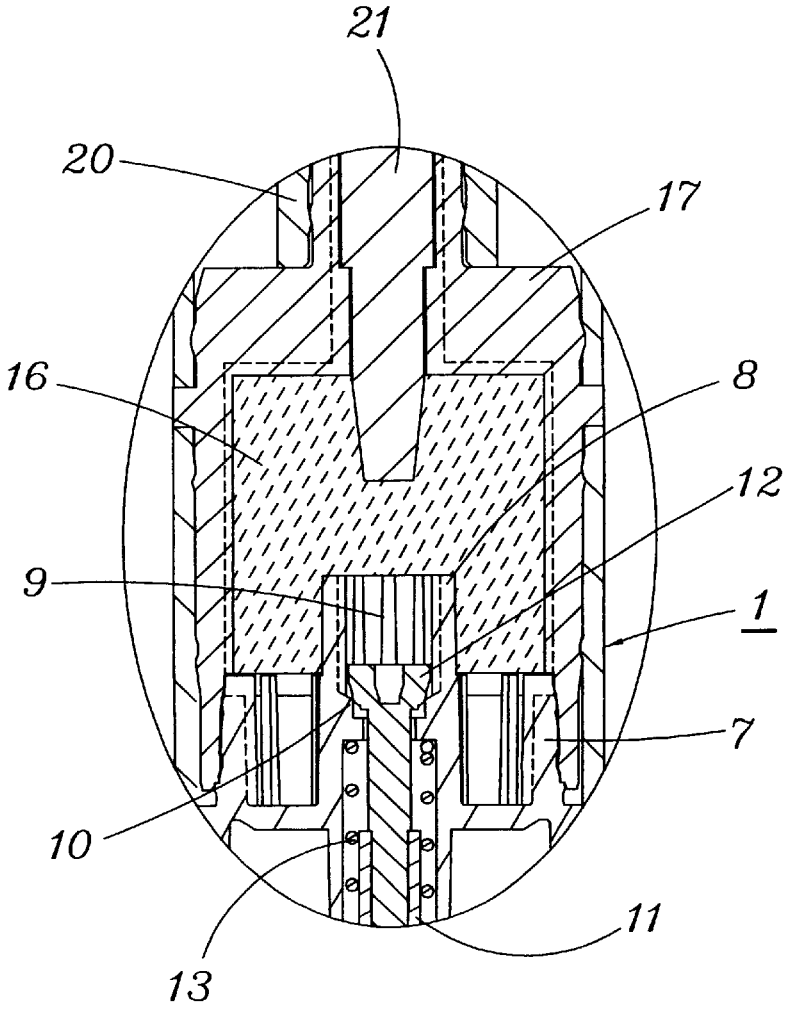
FIG. 2 is an enlarged view of an essential portion of a hair dyeing tool shown in FIG. 1.
Figure 4:
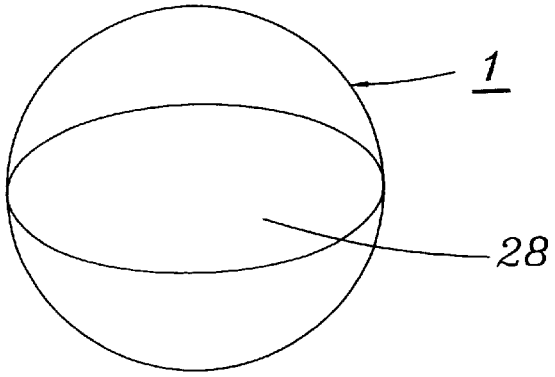
FIG. 4 is a top plan view of the hair dyeing tool shown in FIG. 3.
Figure 5:
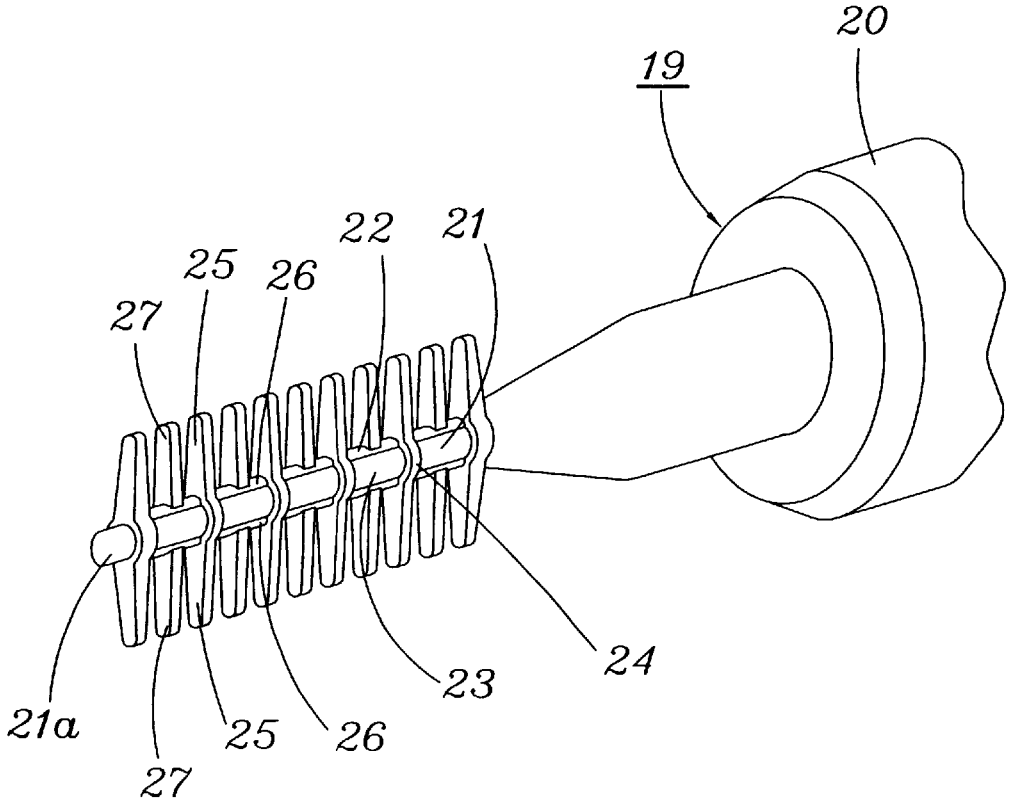
FIG. 5 is a perspective view of an essential portion of the hair dyeing tool shown in FIG. 1 but with a cap removed therefrom.
Figure 6:
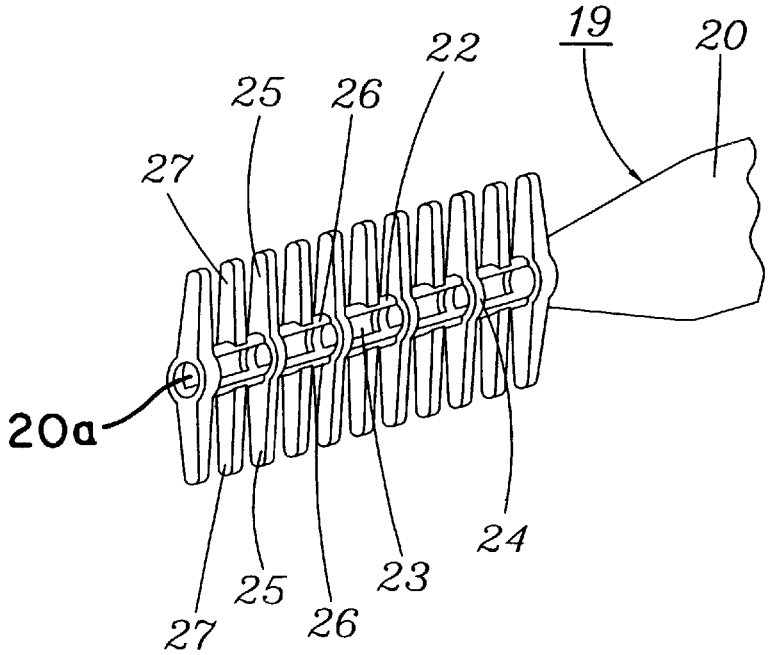
FIG. 6 is a perspective view of the essential portion.
Figure 7:
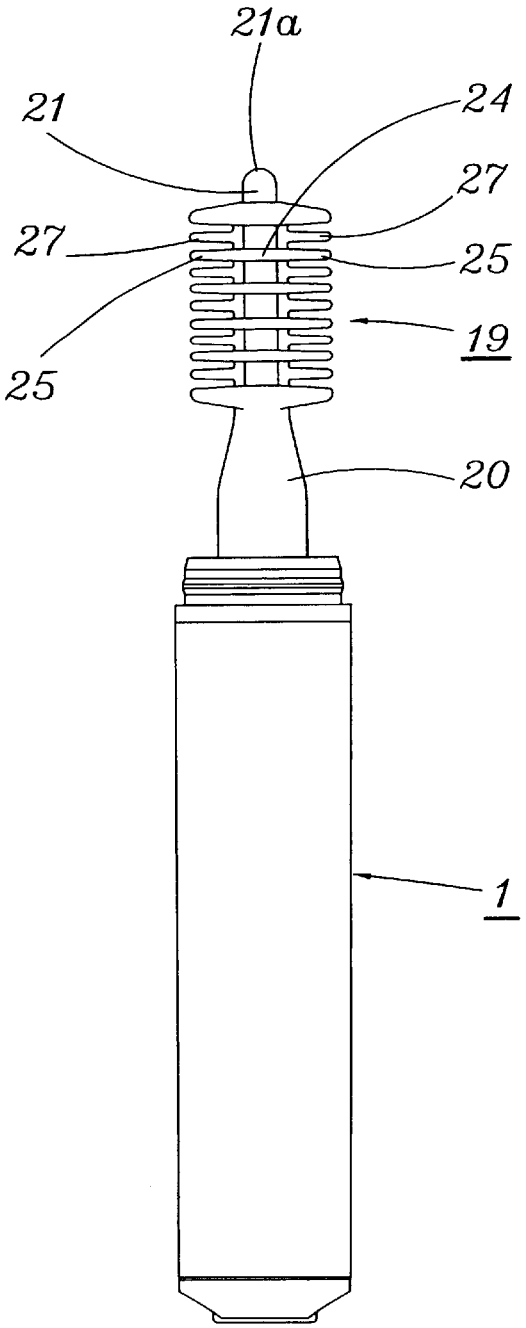
FIG. 7 is a front view of the hair dyeing tool shown in FIG. 1 but with a cap removed therefrom.
Figure 8:
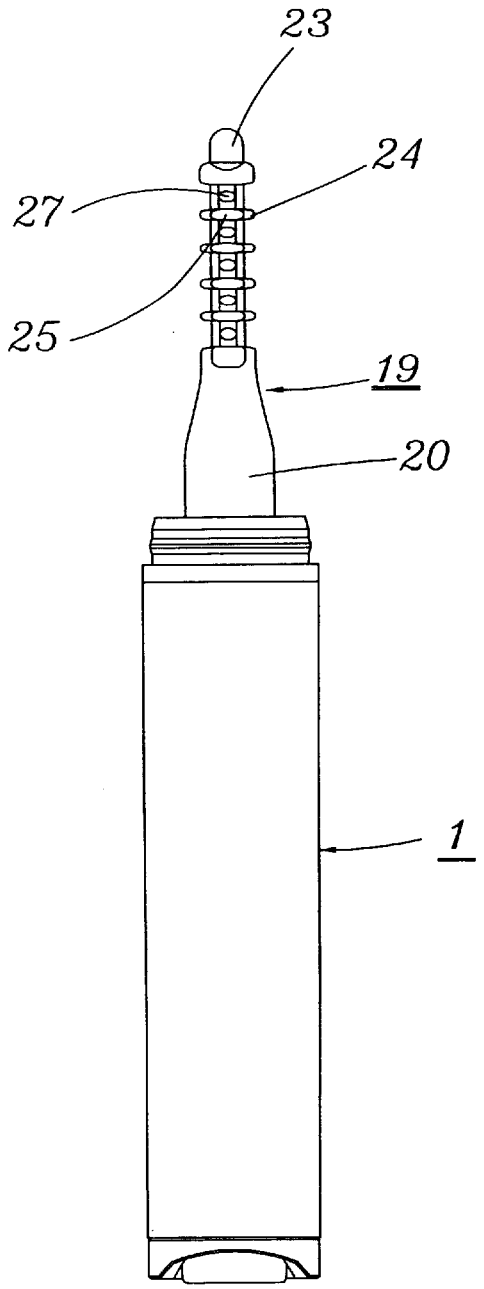
FIG. 8 is a side view of the hair dyeing tool shown in FIG. 7.
Figure 9:
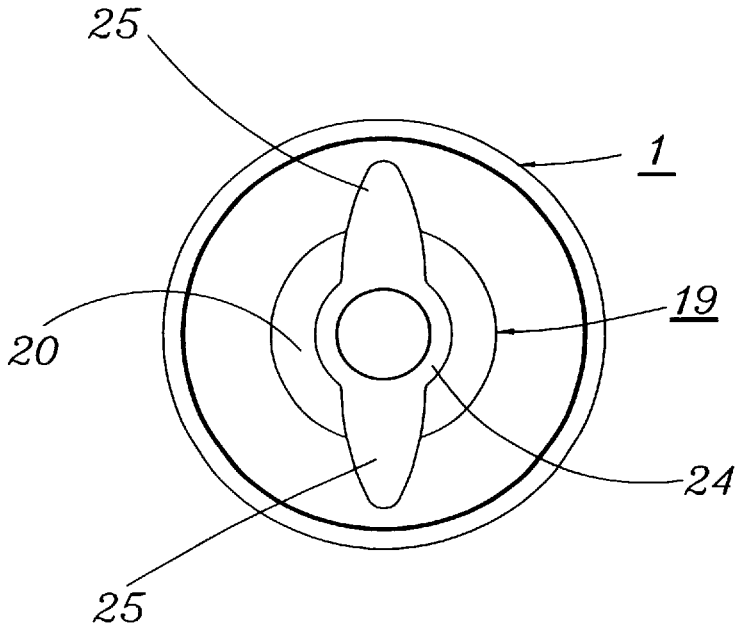
FIG. 9 is a top plan view of the hair dyeing tool shown in FIG. 7.

The present invention will be described in detail hereinafter with reference to the accompanying drawings. A coating liquid (or a hair dye liquid) 2 for dyeing a head hair is directly stored in a container body 1. That is to say, the container body 1 itself serves directly as a fluid storage chamber 3. A plurality of cylindrical portions 4, which are longitudinally expansible and restorable, are steppingly formed on a rear portion (the term "rear" or "forward" refers to that side of the container body 1 where a knock cap 6 and a tail plug 14 are located, while the term "front" or "forward" refers to that side of the container body 1 where a coating member 21 and a cap 28 are located) of the container body 1 such that the cylindrical portions 4 are gradually reduced in diameter. The cylindrical portion 4, which is located at the rearmost, is formed with a bottom portion 5. Press-fitted to the cylindrical portion having the bottom portion 5 is the knock cap 6, which is larger in diameter than the above-described cylindrical portion. The knock cap 6 may be integrally formed with the container body 1 and the cylindrical portion(s) 4. By pressing the knock cap 6 with a finger, a thumb or the like, the cylindrical portions 4 can be contracted, and by releasing the pressing force against the knock cap 6, the contracted cylindrical portions 4 can be restored into their original expanded states.

The material of the container body 1 is preferably selected from transparent or translucent materials so that remaining quantity of the coating liquid 2 can be visually recognized. However, the preferred material of the container body 1 should not be construed as being limited to those materials. As a specific example of the material which is transparent or translucent, a homopolymer of polypropylene is desirable because it has a high transparency. However, in view of enhancement of shock resistance, a copolymer of polypropylene as a block polymer or a random polymer, or their blend may be used. Examples of other resins may include thermoplastic resins which are of a transparent or translucent grade, such as polyethylene, polycarbonate, polystyrene, methacrylic resin, polyphenylene-based resin, polybutadiene resin, vinyl chloride resin, polysulfone resin, polymethylpentene, polyethylene terephthalate, polyamide, polybutylene terephthalate, acrylonitrile-butadiene-styrene copolymer, acrylonitrile-styrene copolymer, fluororesin and the like. The above resin may be applied with a color(s) using a dye-based or pigment-based colorant to the extent that the inside state can be visually recognized. It is also accepted that a resin layer(s) of a fluorocarbon or silicon-based water-repellent oil-repellent agent is formed on an inner surface of the container body 1 (fluid storage chamber 2). This structure will enhance the visibility.

A closure member 7 is press-fitted to an inner intermediate portion of the container body 1. This closure member 7 serves as a front plug of the fluid storage chamber 3. A forwardly projecting protrusion 8 is formed on a central area of the closure member 7. A through-hole 9 is formed in the protrusion 8. A valve seat 10 is formed on an intermediate portion of the through-hole 9. A valve rod 11 is pierced into the through-hole 9. A valve portion 12, which is formed on a distal end of the valve rod 11, is in abutment with the valve seat 10. The valve rod 11 extends backwardly and a rear part of the valve rod 11 reaches the bottom portion 5 of the cylindrical portions(s) 4. The valve rod 11 is biased backwardly by a resilient member 13 such as a coil spring. In other words, the valve portion 12 is normally placed into an abutment relation with the valve seat 10 by the resilient member 13 such that the fluid 2 stored in the fluid storage chamber 3 is prohibited from flowing out through the through-hole 9.

The material of the valve portion 12 (and valve rod 11) should be selected from those that can provide a sufficient sealability to the valve mechanism. It is preferable to use polypropylene or a blended article of polypropylene and polyethylene obtained by ejection molding and having a lower bending modulus of elasticity than the material of the closure member 7 and having a tensile stress at breaking of 200 $Kg/cm^2$ or more (value according to the measuring method of JIS K7113).

Reference numeral 14 denotes a tail plug disposed at a rear end of the container body 1. A rear end face of the tail plug 14 is generally flush with a rear end face of the knock cap 6. A cutout 15 having a dimension just enough to put user's finger therein is formed in the rear end face of the tail plug 14 so that the knock cap 6 would not be accidentally pressed when the hair dyeing tool should be dropped, for example.

Figure 16:
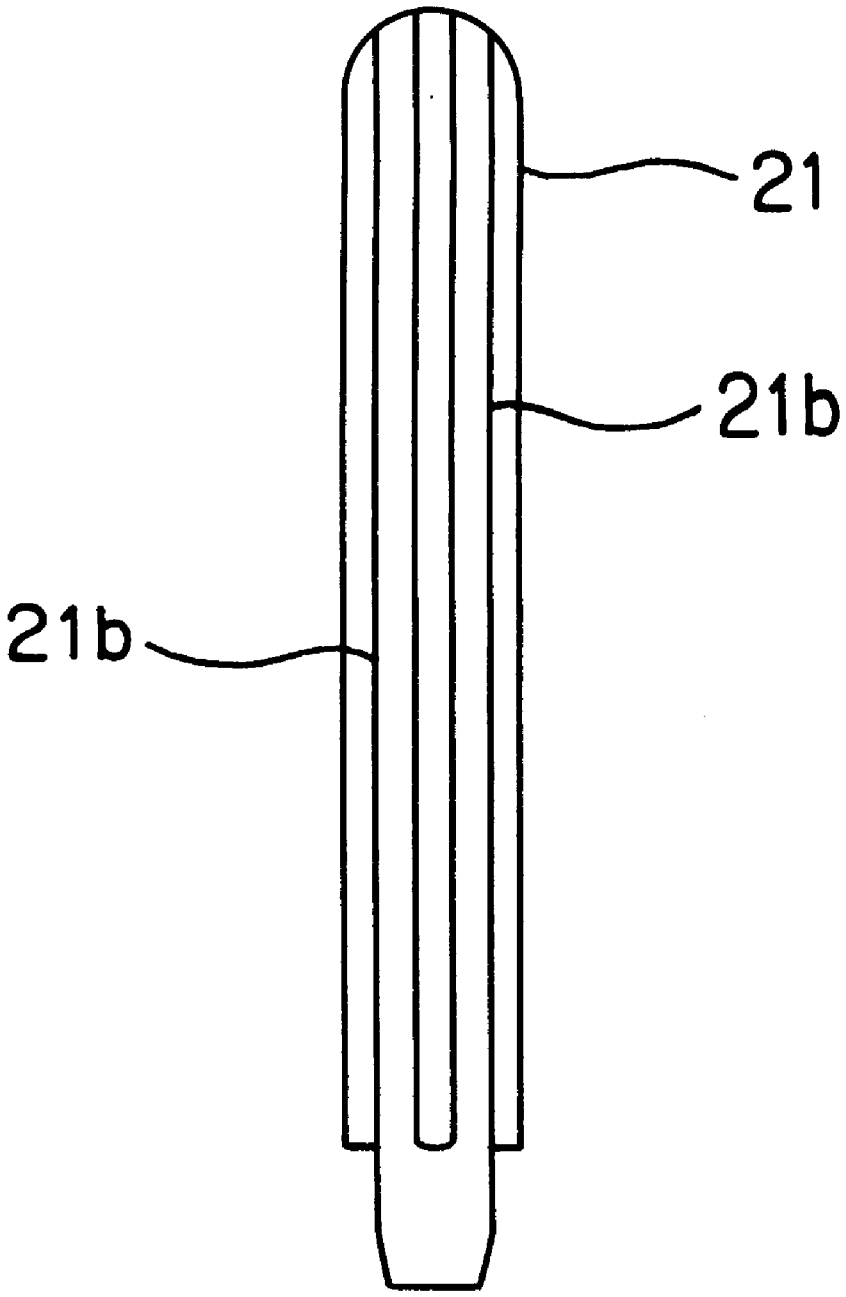
FIG. 16 is an enlarged view of the coating member 21 shown in FIG. 10.

An outlet member 17 having therein a liquid reservoir member 16 is press-fitted to a front portion of the container body 1. The liquid reservoir member 16 is composed of a porous material such as urethane and fiber bundle and adapted to temporarily reserve therein the coating liquid 2 discharged from the fluid storage chamber 3 when the knock cap 6 is knocked. In order to provide a thorough sealability, the outlet member 17 may be firmly secured to the container body 1, for example, by means of bonding. A cylindrical outlet port 18 is formed in a front end face of the outlet member 17. A basal portion 20 of a comb member 19 made of resin material such as polypropylene, polyacetal and nylon is press-fitted to the outlet port 18. A coating member 21 is disposed within the basal portion 20 of the comb member 19. More specifically, the coating member 21 extends through an axial passage 20*a* of the basal portion 20 along a lengthwise direction thereof. The coating member 21 extends forwardly such that a front end thereof projects (projection 21*a*) from the basal portion 20. On the other hand, a rear end of the coating member 21 reaches a nearby area of the front end of the valve mechanism (protrusion 8). The coating member 21 has an elongate configuration in order to facilitate the coating liquid 2 discharged from the valve mechanism to permeate into the coating member 21 rapidly. The coating member 21 is composed of intermediate cotton in the form of fiber bundle, such as polypropylene fiber, acrylic fiber, polyester fiber, nylon fiber and rayon-based fiber, a porous soft member such as polypropylene, polyethylene, ester, ether, urethane-based resin, or a hard member obtained by baking (sintering) those fibers. The coating member 21 may be of a so-called dual structure consisting of a baked hard inner member coated (or covered) with a soft member made of urethane-based resin. As shown in FIG. 16, a plurality of grooves 21*b* may be formed in a surface of the coating member 21, which is composed of the above-mentioned material, in the longitudinal direction. By forming the grooves 21*b*, the surface area of the coating member 21 can be increased and in addition, a small quantity of coating liquid can be reserved in the grooves. Accordingly, a sufficient quantity of coating fluid can be held by the coating member.

A front portion of the basal portion 20 of the comb member 19 is formed as a reduced-diameter portion 22. A plurality of window holes 23 are regularly formed in the reduced-diameter portion 22. The total area of the window holes 23 occupies a most part of the reduced-diameter portion 22. In a sense, the reduced-diameter portion 22 is formed of a skeleton. First comb portions 25 are formed, in opposing relationship, on each of ring-shaped portions 24 formed between adjacent window holes 23. The first comb portions 25 may be formed only on one side of the ring-shaped portions 24.

The ring-shaped portions 24 are connected together through two upper and lower bridge elements 26 of the reduced-diameter portion 22. Second comb portions 27 having the same configuration as the first comb portions 25 formed on the ring-shaped portions 24 are formed likewise in opposing relationship at intermediate portions of the bridge elements 26.

As apparent from the foregoing description, the reduced-diameter portion 22 is formed of a skeleton-like member. Accordingly, a most part of the coating member 21 is exposed from the reduced-diameter portion 22 and the coating member 21 is held by and between the ring-like portions 24 and the upper and lower bridge elements 26.

Reference numeral 28 denotes a cap, which is adapted to prevent the coating member 21 from getting dried. The cap 28 is detachably fitted to the outlet member 17.

An operation of the hair dyeing tool of the present invention will now be described.

First, the container body 1 is held in a hand and a front part of a finger is placed over the cutout portion 15 of the tail plug 14, and the knock cap 6 at the rear portion of the container body 1 is knocked or pressed with the tip area of the finger. As a consequence, the cylindrical portion(s) 4 is contracted and the bottom portion 5 presses the rear end of the valve rod 11 so that the valve rod 11 advances against the resilient force of the resilient member 13. The advancement of the valve rod 11 causes the valve portion 12 to depart from the valve seat 10 so that the valve mechanism is released.

When the valve mechanism is released, the coating liquid 2 stored in the fluid storage chamber 3 is allowed to pass through the through-hole 9 formed in the protrusion 8, then discharged into the liquid reservoir member 16 and finally supplied to the coating member 21. By this, all preparation for use of the tool is finished. In the beginning of use, it may occur that the coating liquid 2 is not thoroughly permeated into the coating member 21. So, it is desirable that the knock cap 6 is knocked several times.

Subsequently, the container body 1 is properly held again in a hand and that part of the coating member 21 which is exposed from the window holes 23 of the reduced-diameter portion 22 is placed on that part of the head hair which is to be dyed. Then, the tool is moved vertically or laterally so that the objective part of the head hair is dyed with the coating, hair dye liquid 2 oozed or seeped out of the coating member 21. Since the ring-shaped portions 24 of the reduced-diameter portion 22 is located on an outer periphery of the coating member 21 at that time, it never happens that the coating member 21 contacts directly the head skin. Thus, the head skin is prevented from getting stained.

Then, the container body 1 is turned about 90 degrees and the head hair to be dyed as well as its nearby hair are combed with the first and second comb portions 25, 27, respectively in such a manner as to spread the colored coating liquid 2. Since the bridge elements 26 are located outside the coating member 21 at that time again, it never happens that the coating liquid 2 is adhered to the head skin by the coating member 21.

In the case where a limited area of the head hair is to be locally dyed, the front projection 21*a* of the coating member 21 is primarily used for dyeing. Since the front end of the coating member 21 projects from the front end of the comb member 19, the projected part can be visually recognized using a mirror or the like. Thus, the desired part of the head hair can be dyed correctly.

Figure 10:
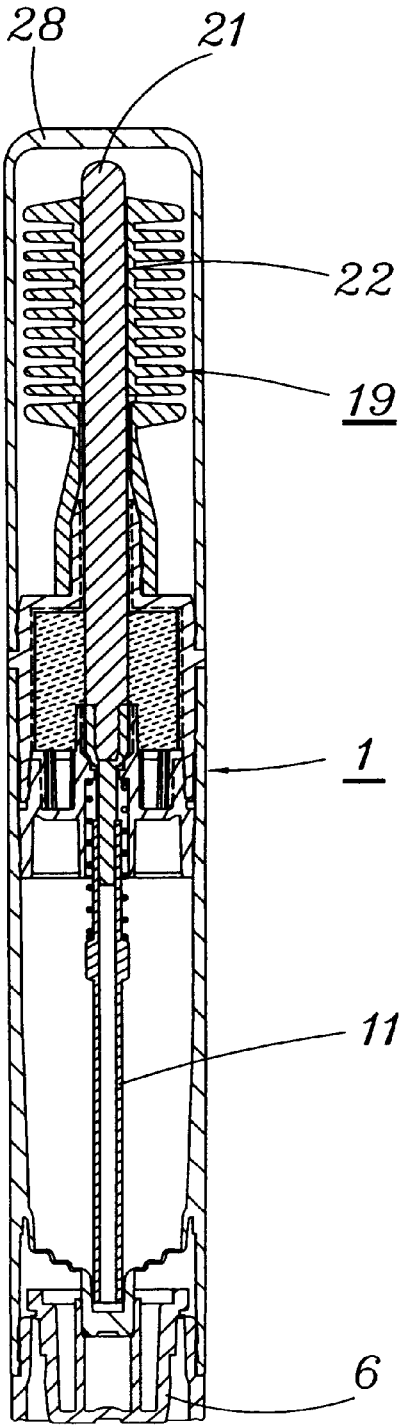
FIG. 10 is a vertical sectional view of a hair dyeing tool according to a second embodiment of the present invention.

A second embodiment of the present invention will now be described with reference to FIG. 10. In this second embodiment, a distal end of the valve rod 11 is connected to a rear end of the coating member 21 and the coating member 21 is moved back and forth by knocking the knock cap 6. The surface of the coating member 21 is slidingly moved along the inner side of the reduced-diameter portion 22 every time the knock cap 6 is knocked so that the surface of the coating member 21 is prevented from being dried and hardened. Even if the surface of the coating member 21 should be hardened, there would be a chance that the surface of the coating member 21 is recovered, though not fully satisfactorily, by slidingly moving the coating member 21 in such a manner as to break the hardened coating liquid.

Figure 12:
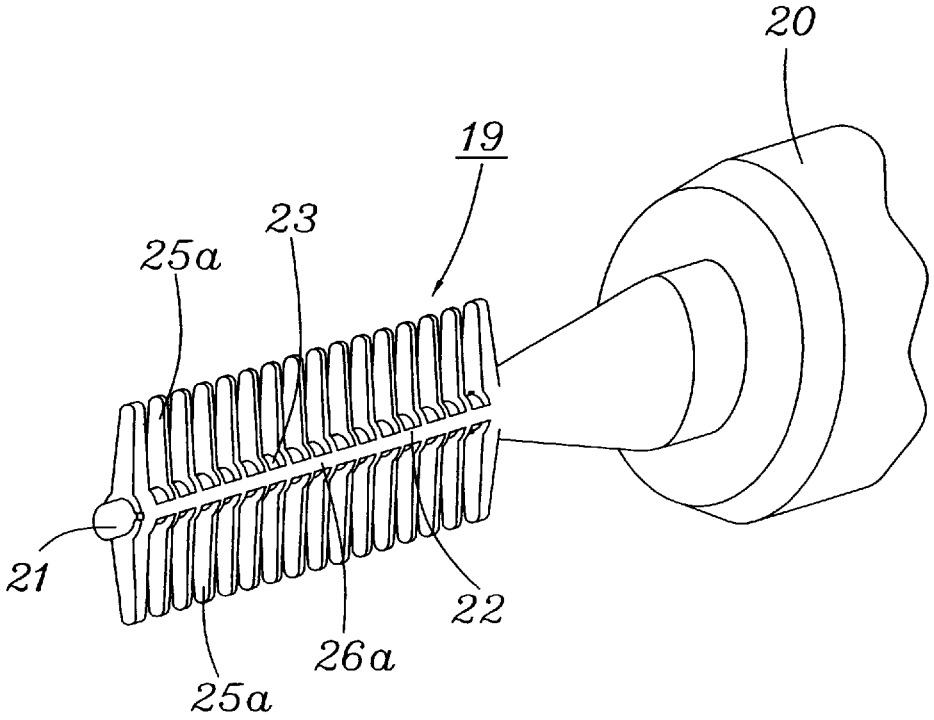
FIG. 12 is a perspective view of an essential portion of the hair dyeing tool shown in FIG. 11 but with a cap removed therefrom.
Figure 11:
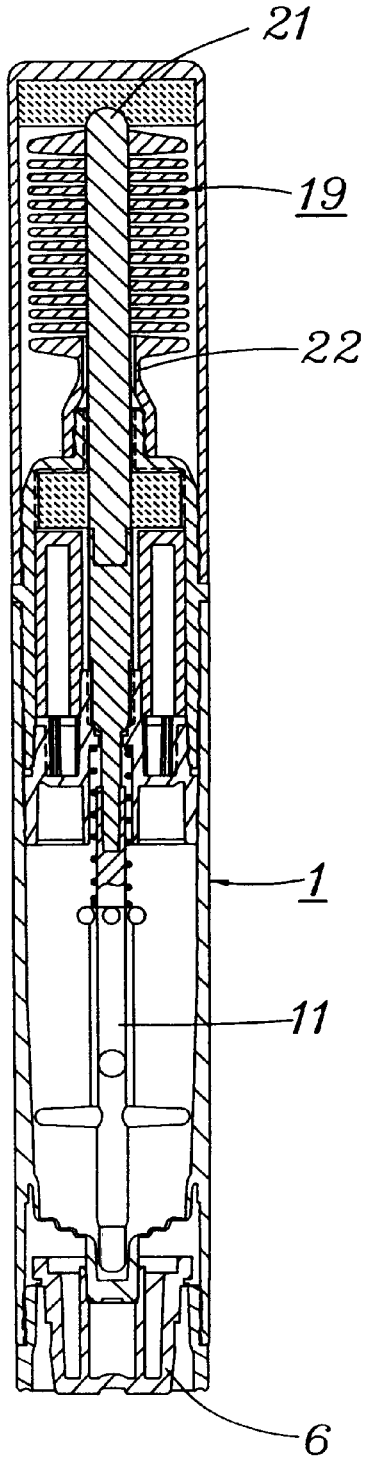
FIG. 11 is a vertical sectional view of a hair dyeing tool of a modification of the second embodiment shown in FIG. 10.

A modified structure of the second embodiment will now be described with reference to FIGS. 11 and 12. In this modification, the comb portions 25*a* are formed, in opposing relationship, on the ring-shaped portions 24 of the reduced-diameter portion 22 and the ring-shaped portions 24 are connected through two left and right bridge elements 26*a* of the reduced-diameter portion 22. Since the window holes 23 are located at the root areas of the comb portions 25*a*, hair can be dyed with the coating liquid 2 seeped out of the coating member 21 while combing the hair with the comb portions.

Figure 13:
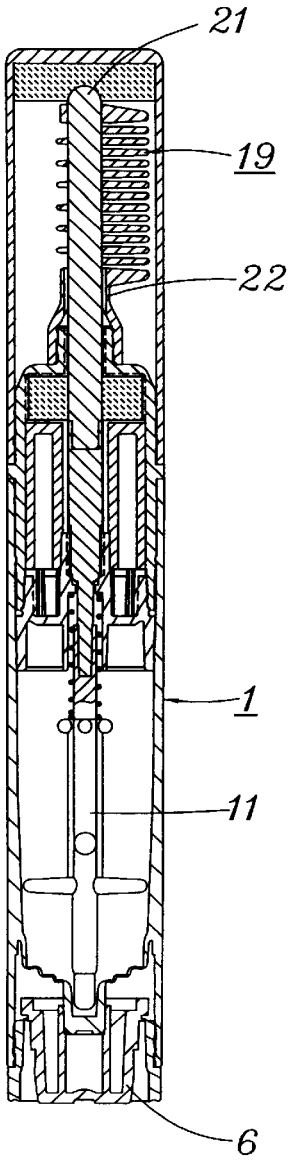
FIG. 13 is a further modified embodiment of a hair dyeing tool according to a second embodiment of the present invention.
Figure 14:
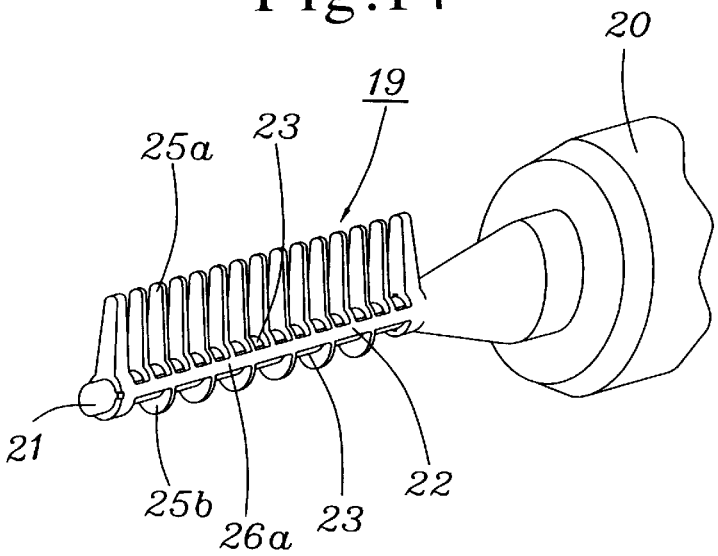
FIG. 14 is a perspective view of an essential portion of a hair dyeing tool shown in FIG. 13 but with the cap removed therefrom.

Another modified example of the second embodiment will now be described with reference to FIGS. 13 and 14. In this modification, the comb portions 25*a* are formed only on one side of the reduced-diameter portion 22. Long hair can be dyed while combing with the comb portions 25*a* and short hair can be dyed with the coating liquid 2 seeped out of that part of the coating member 21 which is exposed from the window holes 23 on the opposite side of the comb portions 25*a*.

Since the ring-shaped portions 25*b* are located on the outer periphery of the coating member 21, it never occurs that the coating member 21 contacts directly the head skin. Thus, the head skin is prevented from getting stained.

Figure 15:
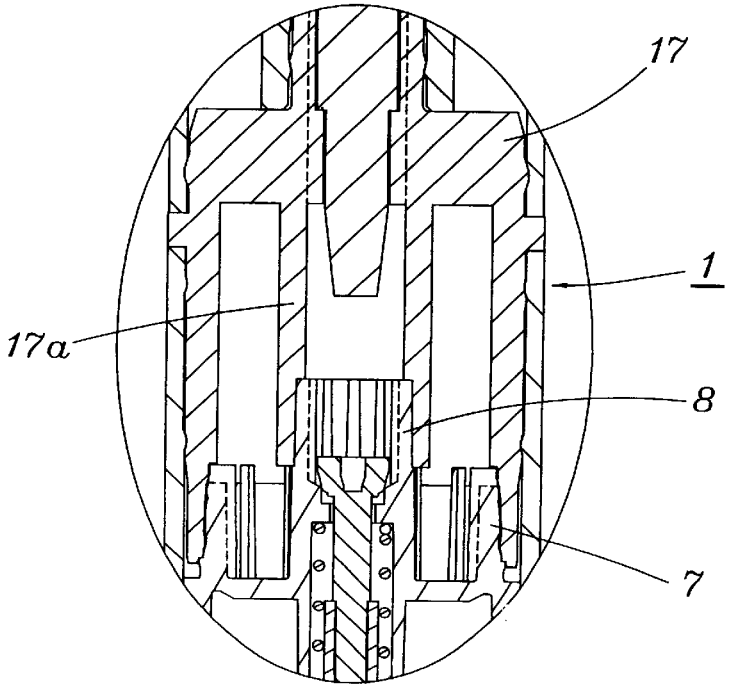
FIG. 15 is an enlarged vertical sectional view of an essential portion showing a hair dyeing tool according to a third embodiment of the present invention.

A third embodiment of the present invention will now be described with reference to FIG. 15. In the third embodiment, a rear cylindrical portion 17*a* formed on a rear part of the outlet member 17 is connected to a cylindrical protrusion 8 on the closure member 7 without a need of a provision of the liquid reservoir member 16 of the first embodiment. Since the coating liquid 2 discharged from the valve mechanism is supplied directly to the coating member 21, the coating liquid 2 is rapidly permeated into the coating member 21. Therefore, the tool can be used soon. This is especially effective when a coating liquid having a comparatively high viscosity is used.

Although the cylindrical portion 17*a* is formed on a rear part of the outlet member 17 and the cylindrical portion 17*a* is connected to the protrusion 8 in this embodiment, it is also accepted that the cylindrical member 17*a* is separately formed from the outlet member 17 and the protrusion 8 is connected to the outlet member 17.

As described hereinbefore, according to the present invention, there is provided a hair dyeing tool including a fluid storage chamber defined within a container body and adapted to store a coating liquid therein and a coating member having a comb member disposed forwardly of the container body, wherein the container body serves directly as the fluid storage chamber, a valve mechanism is disposed between the fluid storage chamber and the comb member, and a rear knock member disposed backwardly of the container body is actuated by the valve mechanism so that the coating liquid is ejected forwardly. Accordingly, an inexpensive hair dyeing tool can be offered to users without sacrificing the efficiency of the product.

What is claimed is:

1. A hair dye applicator comprising:

a container body having a forward end portion and a rear end portion;

a fluid storage chamber disposed within the container body for storing a hair dye liquid;

a comb member disposed at the forward end portion of the container body, the comb member having an axial passage extending along a lengthwise direction thereof;

a coating member disposed in the axial passage of the comb member for undergoing slidable movement therein;

a valve mechanism disposed between the comb member and the fluid storage chamber for controlling a flow of hair dye liquid from the fluid storage chamber to the coating member and for sliding the coating member in the axial passage of the comb member forwardly and rearwardly in the lengthwise direction of the comb member; and a knock member disposed at the rear end portion of the container body for actuating the valve mechanism to control the flow of hair dye liquid to the coating member and to slide the coating member in the axial passage of the comb member.

2. A hair dye applicator according to claim 1; further comprising a liquid reservoir member disposed between the fluid storage chamber and the comb member for temporarily storing hair dye liquid flowing from the fluid storage chamber to the coating member.

3. A hair dye applicator according to claim 2; wherein the comb member has a plurality of comb portions extending from a peripheral surface thereof.

4. A hair dye applicator according to claim 3; wherein the comb member has a basal portion having the axial passage and a plurality of communication holes for communicating the axial passage to the peripheral surface of the comb member so that hair dye liquid flowing from the fluid storage chamber to the coating member can seep to the peripheral surface of the comb member through the communication holes.

5. A hair dye applicator according to claim 1; wherein the coating member has a plurality of longitudinal grooves formed in a peripheral surface thereof for receiving hair dye liquid from the fluid storage chamber; and wherein the comb member has a plurality of comb portions extending from a peripheral surface thereof.

6. A hair dye applicator according to claim 1; wherein the comb member has a basal portion having the axial passage and a plurality of communication holes for communicating the axial passage to a peripheral surface of the comb member so that hair dye liquid flowing from the fluid storage chamber to the boating member can seep through the communication holes and flow to the peripheral surface of the comb member.

7. A hair dye applicator according to claim 1; further comprising a liquid reservoir member disposed between the fluid storage chamber and the comb member for temporarily storing hair dye liquid flowing from the fluid storage chamber to the coating member; and wherein the coating member has an end portion projecting into the liquid reservoir member.

8. A hair dye applicator according to claim 1; wherein the comb member has a plurality of comb portions extending from a peripheral surface thereof.

9. A hair dye applicator according to claim 1; wherein the valve mechanism comprises a valve rod having a first end portion connected to the coating member and a second and portion opposite the first end portion and connected to the knock member.

10. A hair dye applicator comprising: a container body having a forward end portion and a rear end portion; a fluid storage chamber disposed within the container body for storing a hair dye liquid; a comb member disposed at the forward end portion of the container body, the comb member having a peripheral surface, an axial passage extending along a lengthwise direction thereof, and a plurality of comb portions extending from the peripheral surface; a coating member disposed in the axial passage of the comb member for undergoing slidable movement therein, the coating member having a plurality of longitudinal grooves formed in a peripheral surface thereof for receiving hair dye liquid from the fluid storage chamber; a valve mechanism disposed between the comb member and the fluid storage chamber for controlling a flow of hair dye liquid from the fluid storage chamber to the coating member and for sliding the coating member in the axial passage of the comb member forwardly and rearwardly in the lengthwise direction of the basal portion of the comb member; a liquid reservoir member disposed between the fluid storage chamber and the comb member for temporarily storing hair dye liquid flowing from the fluid storage chamber to the coating member; and a knock member disposed at the rear end portion of the container body for actuating the valve mechanism to control the flow of hair dye liquid to the coating member and to slide the coating member in the axial passage of the comb member.

11. A hair dye applicator according to claim 10; wherein the comb member has a basal portion having the axial passage and a plurality of communication holes for communicating the axial passage to the peripheral surface of the comb member so that hair dye liquid flowing from the fluid storage chamber to the coating member can seep through the communication holes and flow to the comb portions.

12. A hair dye applicator according to claim 10; wherein the valve mechanism comprises a valve rod having a first end portion connected to the coating member and a second end portion opposite the first end portion and connected to the knock member.

13. A hair dye applicator comprising: a container body having a forward end portion and a rear end portion; a fluid storage chamber disposed within the container body for storing a hair dye liquid; a comb member disposed at the forward end portion of the container body, the comb member having an axial passage extending along a lengthwise direction thereof; a coating member having a fiber body comprised of a plurality of fibers, the coating member being disposed in the axial passage of the comb member for undergoing slidable movement therein; and a valve mechanism disposed between the comb member and the fluid storage chamber for controlling a flow of hair dye liquid from the fluid storage chamber to the coating member and for sliding the coating member in the axial passage of the comb member forwardly and rearwardly in the lengthwise direction of the comb member so that solidified, gelled or viscous matters formed by the hair dye liquid in the fibers of the coating member are peeled off the fibers.

14. A hair dye applicator according to claim 13; further comprising a knock member disposed at the rear end portion of the container body for actuating the valve mechanism to control the flow of hair dye liquid to the coating member and to slide the coating member in the axial passage o the comb member.

15. A hair dye applicator according to claim 13; wherein the valve mechanism comprises a valve rod having a first end portion connected to the coating member and a second end portion opposite the first end portion.

16. A hair dye applicator according to claim 15; further comprising a knock member connected to the second end portion of the valve rod for sliding the coating member in the axial passage of the comb member during a knocking operation of the knock member.

17. A hair dye applicator according to claim 13; wherein the coating member has a plurality of longitudinal grooves formed in a peripheral surface thereof for receiving hair dye liquid from the fluid storage chamber.

18. A hair dye applicator according to claim 13; wherein the comb member has a basal portion having the axial passage and a plurality of communication holes for communicating the axial passage to a peripheral surface of the comb member so that hair dye liquid flowing from the fluid storage chamber to the coating member can seep through the communication holes and flow to a peripheral surface of the comb member.

19. A hair dye applicator according to claims; wherein the container body comprises a tubular shell having an outer wall portion forming the fluid storage chamber.

* * * * *